US005606805A

United States Patent [19]

Meyer

[11] Patent Number: 5,606,805

[45] Date of Patent: Mar. 4, 1997

[54] PROCESS FOR DRYING A COATED MOVING WEB

[76] Inventor: Jens-Uwe Meyer, 54 Audubon Dr., Suffield, Conn. 06078

[21] Appl. No.: 625,286

[22] Filed: Apr. 1, 1996

[51] Int. Cl.[6] ..... F26B 7/00

[52] U.S. Cl. ..... 34/421; 34/267; 34/420

[58] Field of Search ..... 34/267, 420, 421, 34/422, 629, 641, 643, 656, 655

[56] References Cited

U.S. PATENT DOCUMENTS

| | | | |
|---|---|---|---|
| 3,183,604 | 5/1965 | Stauffer | 34/421 |
| 3,460,265 | 8/1969 | Smith, Jr. | 34/267 |
| 3,623,235 | 11/1971 | Smith, Jr. | 34/420 |
| 4,198,764 | 4/1980 | Ellison et al. | 34/267 |
| 4,472,888 | 9/1984 | Spiller | 34/641 |
| 4,936,025 | 6/1990 | Heikkilä | 34/420 |
| 4,942,674 | 7/1990 | Karlsson | 34/421 |
| 5,009,016 | 4/1991 | LePisto et al. | 34/421 |
| 5,299,362 | 4/1994 | Baldinger | 34/273 |

*Primary Examiner*—Henry A. Bennett
*Assistant Examiner*—Dinnatia Doster
*Attorney, Agent, or Firm*—Howard J. Greenwald

[57] ABSTRACT

A process for drying a web of material moving at a speed of at least about 150 feet per minute. In the first step of the process, a web of material is contacted with a first mixture of air and flue gas while passing the web under a first air nozzle. Thereafter, a portion of the first air/flue gas mixture is exhausted through a first exhaust nozzle disposed less than 12 inches away from the first air nozzle. Thereafter, the web is passed under a multiplicity of gas fired infrared radiation emitting burners while contacting said moving web with infrared radiation and flue gas and heating said moving web to a temperature of from about 100 to about 280 degrees Fahrenheit. Thereafter, the web is contacted with a second mixture of air and flue gas while passing it under a second air nozzle.

(d) contacting said web of material with a second mixture of air and flue gas while passing said web under a second air nozzle, wherein said second mixture of air and flue gas is at a temperature of from about 200 to about 850 degrees Fahrenheit, and wherein said air exits said second air nozzle at a velocity of from about 4,000 to about 12,000 feet per minute; and (e) exhausting a portion of said second mixture of air and flue gas through a second exhaust nozzle disposed less than 12 inches away from second air nozzle.

8 Claims, 5 Drawing Sheets

32
42
46
64
64
66
24
28
11
25

PROCESS FOR DRYING A COATED MOVING WEB

FIELD OF THE INVENTION

A process for drying a moving web of material such as, a moving paper web.

BACKGROUND OF THE INVENTION

Processes and apparatuses for drying coated moving webs of material are known to those skilled in the art. Thus, e.g., U.S. Pat. Nos. 4,936,025, 5,009,016, and 5,261,166 describe some illustrative prior art processes.

As is disclosed in U.S. Pat. No. 4,936,025, paper webs are coated by means of either separate coating devices, and/or by means of on-machine devices integrated in paper machines, and/or by means of surface-sizing devices (see lines 29–37 of column 1).

Attempts have repeatedly been made to increase the efficiency of the devices for drying coated paper webs. Thus, as is disclosed at lines 36–38 of U.S. Pat. No. 5,261,166, "Various attempts have been made in the prior art for decreasing the length and/or increasing the efficiency and line speed of such dryers." These attempts have not been entirely successful.

The efficiency of a drying system can be calculated by determining the number of pounds of water actually evaporated from the moving web. The theoretical amount of energy required to remove such amount of water can be calculated and then divided into the actual amount of energy consumed in the process. The ratio, times 100, is the percent efficiency of the process.

With present commercially available systems, the maximum drying efficiency obtained with moving coated paper webs is generally less than 50 percent. Furthermore, even with this relatively low efficiency, quality problems with the dried web often appear. Thus, the dried coated paper webs often demonstrate print mottle and other problems which frequently are caused by poor adhesion of the coating to the substrate.

It is an object of this invention to provide a process for drying a moving coated web of material which is substantially more efficient than prior art processes.

It is another object of this invention to provide a process for drying a moving coated web of material which, at an efficiency greater than 75 percent, produces a dried coated web of acceptable quality.

It is yet another object of this invention to provide a novel drying apparatus.

SUMMARY OF THE INVENTION

In accordance with this invention, there is provided a drying process in which a moving web of coated material is subjected to the sequential steps of being contacted with a first mixture of air and flue gas, being contacted with infrared radiation, and thereafter being contacted with a second mixture of air and flue gas.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
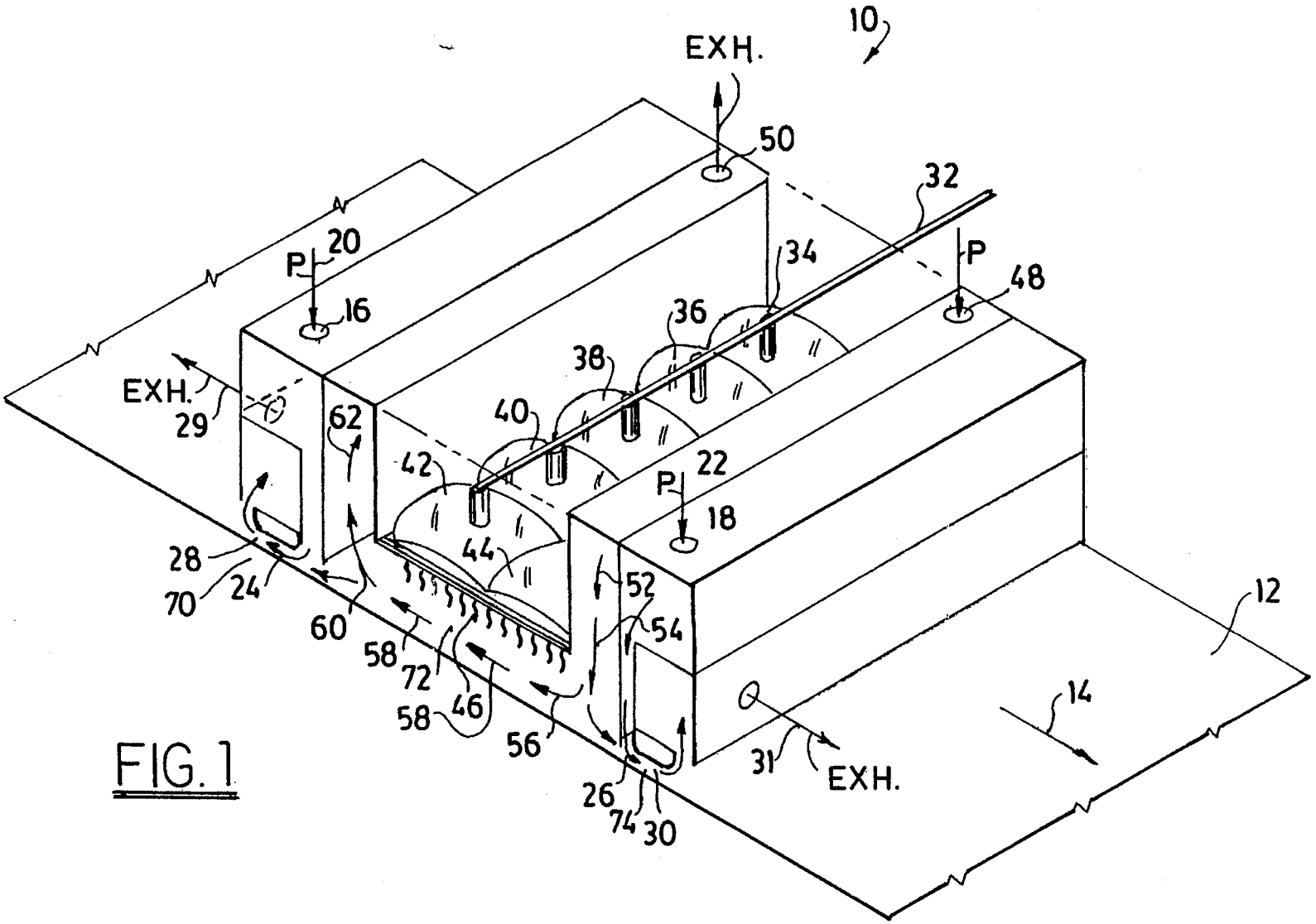
FIG. 1 is a perspective view of one preferred dryer of the invention.

FIG. 1 is a perspective view of one preferred drying apparatus 10. Referring to FIG. 1, disposed under drying apparatus 10 is a moving web 12 which is moved in the direction of arrow 14.

Web 12 preferably is a web of material which preferably has been coated and is moved under apparatus 10 in order to dry it. By way of illustration, web 12 may consist of or comprise coated paper, coated cardboard, and the like. The coated paper, when dried, can be printed on by conventional means. As is known to those skilled in the art, most paper used for printing is coated paper.

Referring again to FIG. 1, and in the preferred embodiment depicted therein, the web of material 12 is moved in the direction of arrow 14 at a speed of about 150 feet per minute to about 6,000 feet per minute. It is desirable to operate web coaters as fast as possible, but this speed is often limited by the rate at which water can be removed from the system.

Referring again to FIG. 1, ambient air is supplied to port 16 and port 18 and caused to flow in the directions of arrows 20 and 22, respectively.

The air supplied to ports 16 and 18 is preferably blown into such ports at a pressure sufficient so that such air will have an exit velocity at nozzle orifices 24 and 26 (also see FIG. 2) of from about 4,000 to about 12,000 feet per minute. In one embodiment, the preferred exit velocity for the air at nozzle orifices 24 and 26 is from about 6,000 to about 10,000 feet per minute.

Referring again to FIG. 1, it is preferred that ambient air be supplied to ports 16 and 18. However, one may use heated air at a temperature of from about 180 to about 550 degrees Fahrenheit.

Figure 3:
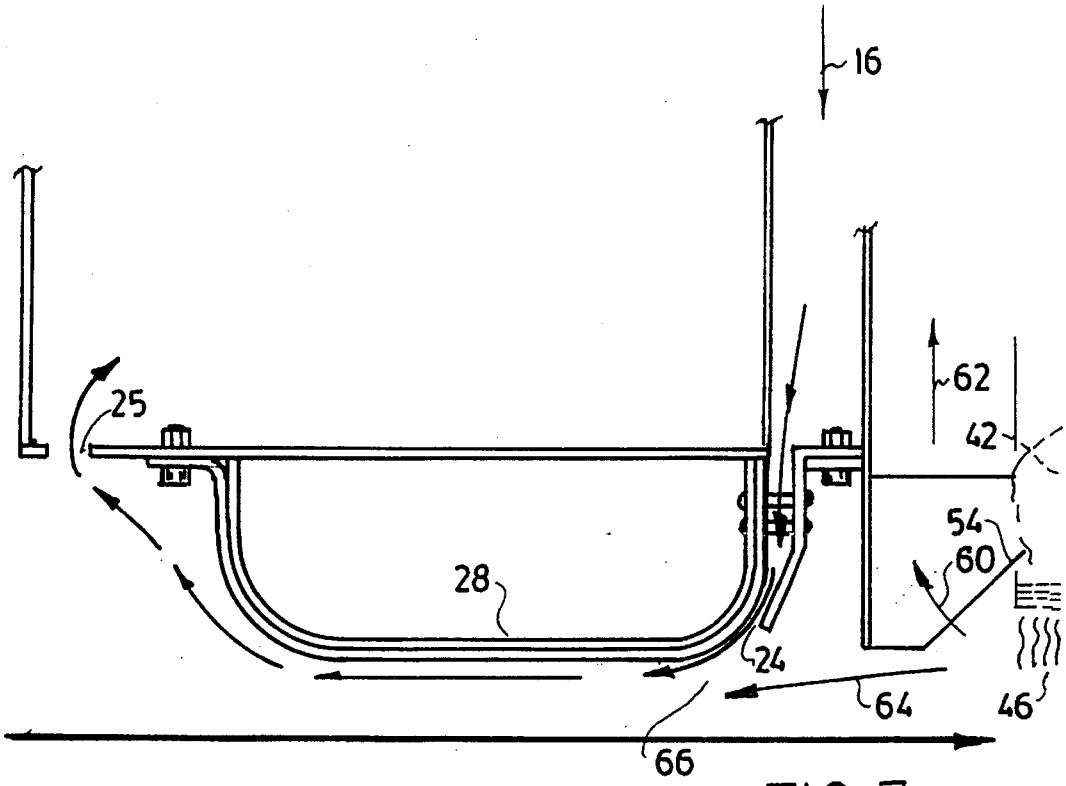
FIG. 3 is a partial side view of the dryer of FIG. 1.
Figure 4:
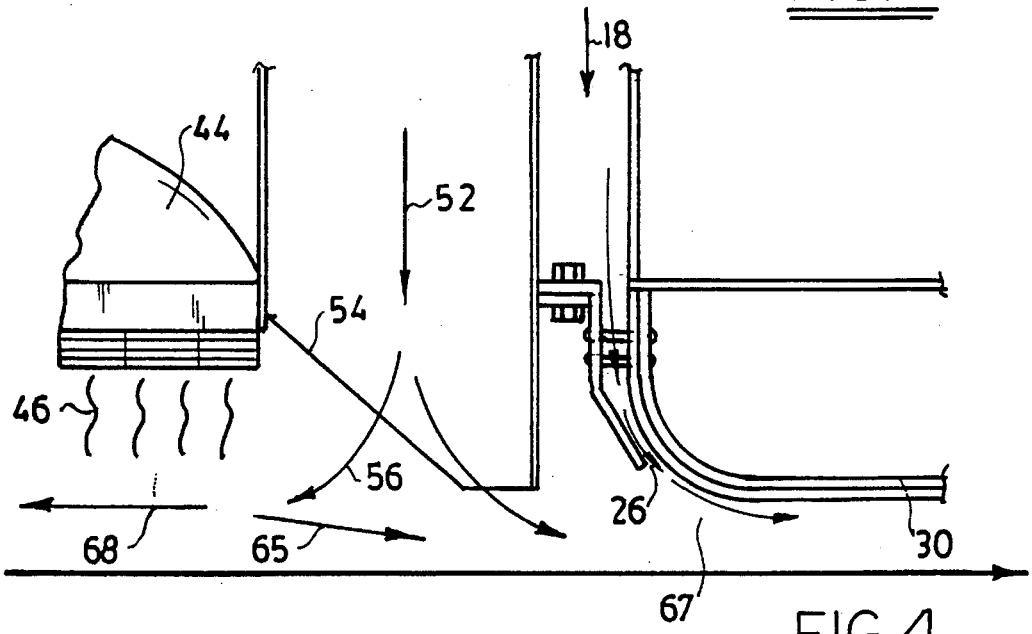
FIG. 4 is another partial side view of the dryer of FIG. 1.

Referring again to FIG. 2, it will be seen that the nozzle orifices 24 and 26 preferably comprise air nozzles 28 and 30. Referring to FIGS. 3 and 4, when air flows through orifice 24 or 26 at a rate of at least about 4,000 feet per minute, a negative pressure area 66 or 67 is created into which flue gases 46 may be drawn in the direction of arrows 64 and 65, respectively.

One suitable nozzle wich will create negative pressure areas 66 or 67 under the aforementioned conditions is a Coanda nozzle. As is known to those skilled in the art, Coanda nozzles create the Coanda effect. The Coanda effect is the tendency of a gas or liquid coming out of an orifice to travel close to the wall contour even if the wall's direction of curvature is away from the jet's axis. Coanda devices, and the effects they produce, are well known to those skilled in the art. Thus, e.g., reference may be had to, e.g., U.S. Pat. Nos. 5,402,938 (Coanda profile), 5,395,029 (Coanda surface), 5,347,805 (Coanda effect), 5,299,364 (Coanda effect), 5,293,946 (Coanda effect), 5,263,700 (Coanda effect), 5,216,224 (Coanda effect), 5,149,401 (Coanda nozzle), 4,601,116 (Coanda nozzle dryer), 4,472,888 (Coanda nozzle effect nozzle for handling continuous webs), 4,201,323

(Coanda plate), and the like. The disclosure of each of these United States patents is hereby incorporated by reference into this specification.

Coanda devices are commercially available. Thus, by way of illustration and not limitation, one can purchase Coanda nozzles from Grace TEC Systems (of DePere, Wis.), from Advanced Systems Inc. (of Green Bay, Wis.), from Spooner Industries, Inc. (of Green Bay, Wis.), from XericWeb Drying Systems (of Neenah, Wis.), and the like.

Referring again to FIG. 1, a gas/air mixture is supplied via manifold 32 to gas fired, radiation emitting infrared burners 34, 36, 38, 40, 42, and 44. These gas fired infrared burners are well known to those skilled in the art and are described, e.g., in U.S. Pat. Nos. 5,361,750 (burner assembly), 5,249,953 (gas fired infrared burner), 5,201,807 (gas fired infrared burner), 5,197,872 (gas fired infrared burner), 3,463,139 (gas fired infrared burner), and the like. The disclosure of each of these United States patents is hereby incorporated by reference into this specification.

By way of further illustration, the gas-fired, radiation emitting infrared burners used may be purchased form the Eclipse Combustion, Inc. of Rockford, Ill.

Referring again to FIG. 1, the combustion of the air gas mixture in the gas fired infrared burners creates a flue gas 46 as a byproduct of the combustion process. The flue gas is caused to flow away from the radiant burners. These flue gases and their composition are well known to those skilled in the art; see, e.g., U.S. Pat. Nos. 5,439,658, 5,439,050, 5,437,851, 5,437,249, 5,435,980, 5,435,975, 5,435,820, 5,433,936, 5,433,934, and the like. The disclosure of each of these United States patents is hereby incorporated by reference into this specification.

Means for removing a flue gas from a system are well known. Thus, referring to U.S. Pat. No. 4,936,025, reference may be had to blowings F1 and F2 and to Column 5 of this patent.

By way of further illustration, and referring again to FIG. 1, air is caused to flow into port 48, and flue gas is thus caused to exhaust through port 50. This process is shown in greater detail in FIG. 2.

Figure 2:
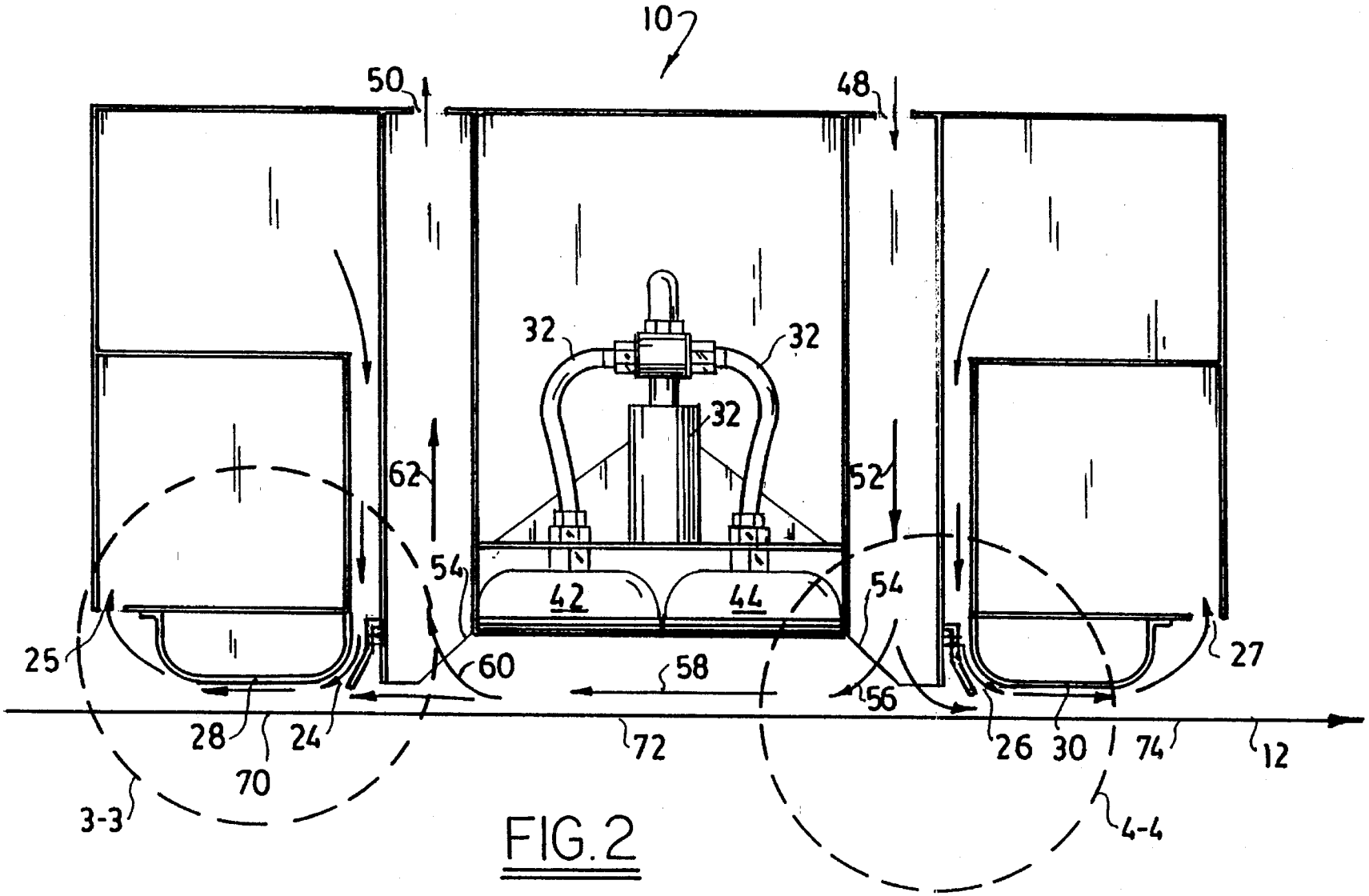
FIG. 2 is a side view of the dryer of FIG. 1.

Referring to FIG. 2, air is blown into port 48 and is caused to flow in the directions of arrows 52, through an orifice (not shown) in flue gas nozzle 54 in the general direction of arrows and 58, and it is combined with some of the flue gas and exhausted in the directions of arrows 60 and 62 through exhaust port 50.

Prior to its combustion, the gas/combustion air mixture generally will contain from about 7 to about 10 parts of air for each part of natural gas and generally will contain sufficient air that at least the stoichiometric amount of oxygen needed to combust all of the gas is present in the mixture. In one embodiment, up to about 10 percent of excess air is used.

Referring to FIG. 3, it will be seen that a portion of flue gases 46 travels via arrows 60 and 62 directly to exhaust, whereas another portion of the flue gases 46 travels via arrow 64 to the Coanda nozzle orifice 24, where it is mixed with air from port 16 (see FIG. 1). Although applicant does not wish to be bound to any particular theory, he believes that, because of the presence of the Coanda nozzle 28, a negative pressure is caused to exist in area 66 to the right of the air jet exiting nozzle orifice 24. It is believed that this negative pressure helps facilitate the flow of flue gas 46 in the direction of arrow 64.

The same process is illustrated in FIG. 4 for nozzle 30. Referring to FIG. 4, it will be seen that a portion of flue gases 46 travels via arrows 68 as well as arrow 56, whereas another portion of the flue gases 46 travels via arrow 65 to the Coanda nozzle orifice 26, where it is mixed with air from port 18 (see FIG. 1). Although applicant does not wish to be bound by any particular theory, he believes that, because of the presence of the Coanda nozzle 26, a negative pressure is caused to exist in area 67 to the left of the air jet exiting nozzle orifice 26. It is believed that this negative pressure helps facilitate the flow of flue gas 46 in the direction of arrow 65

Referring again to FIG. 2, the moving web 12 is contacted by the mixture of air and flue gas produced by apparatus 10 in the areas beneath Coanda nozzles 28 and 30.

The mixture of air and flue gas which contacts the moving web 12 preferably is at a temperature of from about 200 to about 850 degrees Fahrenheit and, more preferably, is at a temperature of from about 250 to about 550 degrees Fahrenheit. In one embodiment, the preferred air/gas mixture preferably contains at least 4 parts of air (by volume) for each part of flue gas present in the mixture. The preferred air/gas mixture preferably flows over and contacts the web 12 at a velocity of form about 4,000 to about 12,000 feet per minute and, more preferably, at a velocity of from about 6,000 to about 10,000 feet per minute.

The air in the air/flue gas mixture is preferably ambient air with an ambient relative humidity, which preferably is less than about 50 percent.

After the mixture of air and flue gas contacts the moving web 12 under each Conanda nozzle, it is exhausted via a separate exhaust for each such nozzle. Thus, referring to FIG. 1, the air/gas mixture passing over Coanda nozzle 28 is exhausted via port 29; and the air/gas mixture passing over Coanda nozzle 30 is exhausted via port 31.

Referring to FIG. 2, the air/flue gas mixture passing beneath Coanda nozzle 28 thereafter exhausts through orifice 25 and thence to port 29 (not shown in FIG. 2, but see FIG. 1). The air/flue gas mixture passing beneath Coanda nozzle 30 thereafter exhausts through orifice 27 and thence to port 31 (not shown in FIG. 2, but see FIG. 1).

In one preferred embodiment, exhaust orifices 25 and 27 are either attached to their respective Coanda nozzles and/or located less than 12 inches away from their respective Coanda nozzles. Without wishing to be bound to any particular theory, applicant believes that the close proximity of each of such exhaust orifices to its respective air nozzle is one of the reasons why applicant's process is unexpectedly efficient.

Figure 5:
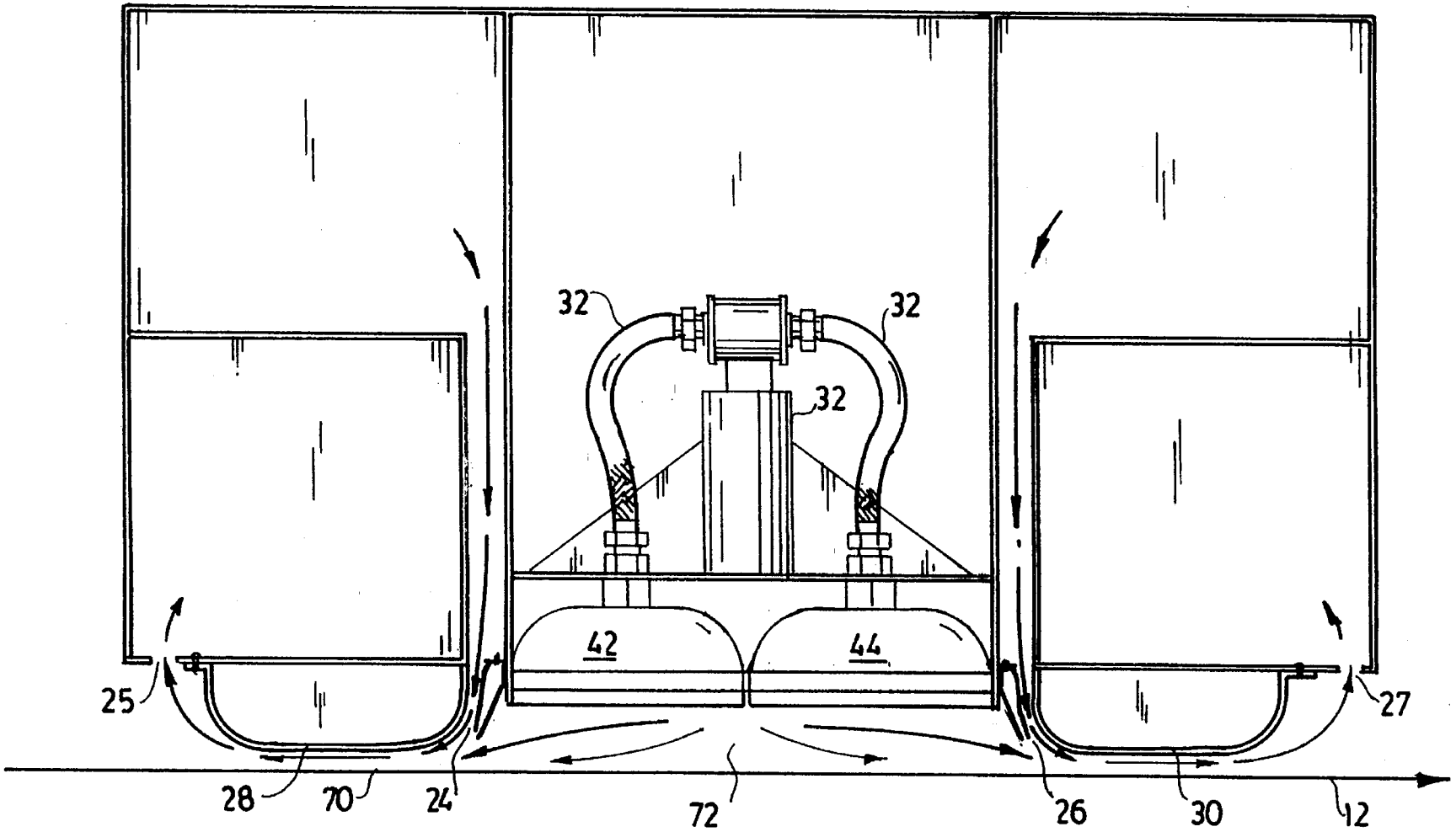
FIG. 5 is a side view of another preferred dryer of the invention.
Figure 6:
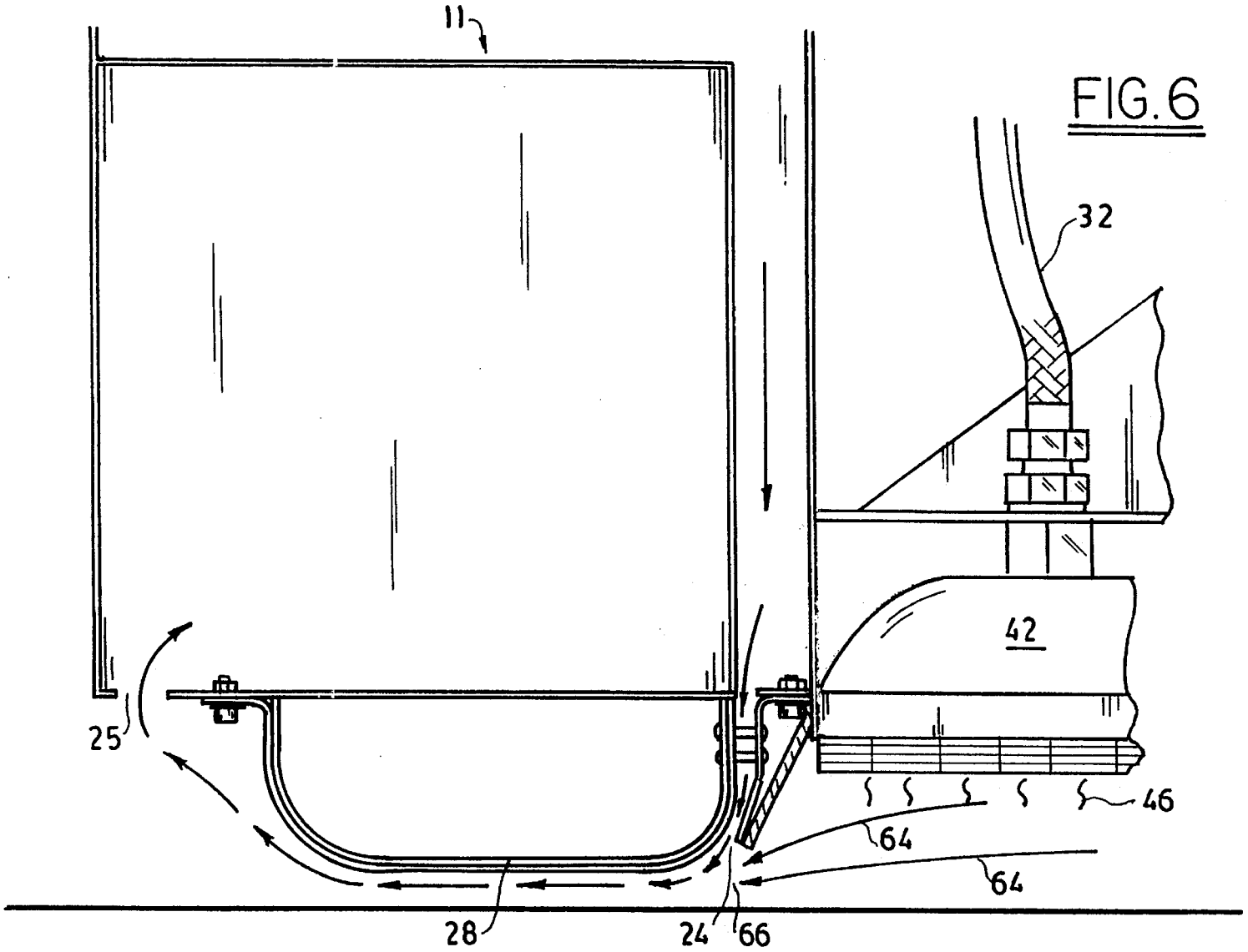
FIG. 6 is a partial side view of the dryer of FIG. 5.

FIGS. 5 and 6 illustrate a dryer assembly 11 which is comparable to the assemblies of FIGS. 1–5 with the exception that they omit the flue gas nozzle assemblies. Thus, ports 48 and 50, flue gas orifices 54, and the ducts carrying the airflows 52 and 62 have been omitted from the assemblies of FIGS. 5 and 6.

As will be apparent to those skilled in the art, the velocity of the air/flue gas mixture can be influenced by the velocity of air flowing into ports 16 and 18. The temperature of the air/flue gas mixture can be controlled by the amount of air flowing into ports 16 and 18 and, additionally, by the amount of air flowing into port 48 and exhausting from port 50. The ratio of air to flue gas also may be controlled in a similar manner.

As will be apparent to those skilled in the art, by controlling the temperature of the air/flue gas mixture, and its velocity, one can control the drying rate of the web 12.

Applicant's process is unexpectedly substantially more efficient than prior art processes. Without wishing to be bound to any particular theory, applicant believes that such increased efficiency is due to the presence of three separate stages in his process.

Referring to FIG. 1, and in the first stage 70 of the process, the moving web 12 is passed under Coanda nozzle 28 while being contacted with the aforementioned mixture of flue gas and air.

In the second stage 72 of the process, the moving web 12 is passed under gas fired infrared radiation emitting burners which generally emit infrared radiation and and create hot flue gases. In general, in this stage, the moving web is subjected to a temperature of from about 100 to about 280 degrees Fahrenheit. It is preferred, in this stage, to subject the moving web to a temperature of from about 120 to about 180 degrees Fahrenheit.

In the third stage 74 of the process, the moving web 12 is subjected to another mixture of flue gas and air.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A process for drying a web of material moving at a speed of at least about 150 feet per minute, comprising the steps of:

(a) contacting said web of material with a first mixture of air and flue gas while passing said web under a first air nozzle, wherein said first mixture of air and flue gas is at a temperature of from about 200 to about 850 degrees Fahrenheit, and wherein said air exits said first air nozzle at a velocity of from about 4,000 to about 12,000 feet per minute;

(b) exhausting a portion of said first mixture of air and flue gas through a first exhaust nozzle disposed less than 12 inches away from said first air nozzle;

(c) thereafter passing said moving web under gas fired infrared radiation emitting burners while contacting said moving web with infrared radiation and flue gas and heating said moving web to a temperature of from about 100 to about 280 degrees Fahrenheit;

(d) contacting said web of material with a second mixture of air and flue gas while passing said web under a second air nozzle, wherein said second mixture of air and flue gas is at a temperature of from about 200 to about 850 degrees Fahrenheit, and wherein said air exits said second air nozzle at a velocity of from about 4,000 to about 12,000 feet per minute; and (e) exhausting a portion of said second mixture of air and flue gas through a second exhaust nozzle disposed less than 12 inches away from second air nozzle.

2. The process as recited in claim 1, wherein said first air nozzle is a coanda nozzle.

3. The process as recited in claim 2, wherein said second air nozzle is a coanda nozzle.

4. The process as recited in claim 3, wherein said air exits said first coanda nozzle at a velocity of from about 6,000 to about 10,000 feet per minute.

5. The process as recited in claim 4, wherein said second air exits said second coanda nozzle at a velocity of from about 6,000 to about 10,000 feet per minute.

6. The process as recited in claim 5, wherein said first mixture of air and flue gas is at a temperature of from about 250 to about 550 degrees Fahrenheit.

7. The process as recited in claim 6, wherein said second mixture of air and flue gas is at a temperature of from about 250 to about 550 degrees Fahrenheit.

8. The process as recited in claim 7, wherein said air in said first mixture of air and flue gas has a relative humidity of less than about 50 percent.

* * * * *